United States Patent [19]

Eke

[11] Patent Number: 4,533,809

[45] Date of Patent: Aug. 6, 1985

[54] MICROWAVE OVENS AND METHODS OF COOKING FOOD

[75] Inventor: Kenneth I. Eke, Sanderstead, England

[73] Assignee: Microwave Ovens Limited, Surrey, England

[21] Appl. No.: 588,336

[22] Filed: Mar. 12, 1984

[30] Foreign Application Priority Data

Mar. 15, 1983 [GB] United Kingdom ..... 8307123

[51] Int. Cl.[3] ..... H05B 6/68

[52] U.S. Cl. ..... 219/10.55 M; 219/10.55 B; 99/325; 426/243

[58] Field of Search ..... 219/10.55 B, 10.55 R, 219/10.55 M, 10.55 E, 400, 492; 99/325, DIG. 14; 426/241, 243

[56] References Cited

U.S. PATENT DOCUMENTS

| | | | |
|---|---|---|---|
| 3,514,576 | 5/1970 | Hilton et al. | 219/400 X |
| 3,569,656 | 3/1971 | White et al. | 219/10.55 B |
| 4,230,731 | 10/1980 | Tyler | 219/10.55 B X |
| 4,236,055 | 11/1980 | Kaminaka | 219/10.55 B |
| 4,332,992 | 6/1982 | Larsen et al. | 219/10.55 R |
| 4,350,860 | 9/1982 | Ueda | 219/10.55 B |
| 4,401,884 | 8/1983 | Kusunoki et al. | 219/10.55 B X |

*Primary Examiner*—Philip H. Leung

*Attorney, Agent, or Firm*—Penrose Lucas Albright

[57] ABSTRACT

A microwave oven delivers microwave power to the oven cavity simultaneously with thermal power provided by a circulation of hot air forced through the cavity by a fan. A temperature sensor in the cavity and timing means monitor the temperature/time variation. If a predetermined maximum temperature (e.g. 250° C.) is reached in the cavity in a predetermined time (e.g. 30 minutes) from commencement of cooking with the oven in a cold condition, the oven automatically switches off to finish the cooking process. Most food items other than large meat or casserole dishes will be cooked within the predetermined time by this method. For larger meat and casserole dishes, where the maximum temperature is reached after the predetermined time, the delivery of microwave power is increased and the delivery of thermal power decreased when the maximum temperature is reached in order to complete cooking of these denser food items.

8 Claims, 4 Drawing Figures

MICROWAVE OVENS AND METHODS OF COOKING FOOD

DESCRIPTION

1. Field of the Invention

This invention relates to microwave ovens and to methods of cooking food.

2. Background to the Invention

Certain known microwave ovens have thermal heating means for delivering thermal power to the oven cavity in addition to a magnetron for delivering microwave power to the oven cavity. Thermal power is used to raise the air temperature within the oven cavity to provide a browning effect which is largely absent from food cooked purely by microwave power. Such ovens generally have complicated control panels for controlling the magnitudes and timings of the thermal power and the microwave power, which makes the ovens confusing and complicated to operate, particularly for cooking or reheating a large range of different foods. An aim of the invention is to provide a combined thermal/microwave oven and a method of cooking food which are simple to operate and achieve or approach the ideal of a fully automatic cooking operation.

SUMMARY OF THE INVENTION

According to one aspect of the invention a microwave oven comprises a microwave generator for supplying microwave power to the cavity of the oven, thermal heating means for supplying thermal power to the cavity simultaneously with the microwave power, sensing means for sensing the temperature or moisture within the cavity, and control means which are responsive to the sensing means for discontinuing the supply of power to the microwave generator and the thermal heating means and thereby finishing cooking when the cavity temperature, or moisture reaches a predetermined level.

According to another aspect of the invention a microwave oven comprises a microwave generator for supplying microwave power to a cavity of the oven, thermal heating means for supplying thermal power to the cavity simultaneously with the microwave power, timing means for monitoring cooking time, temperature sensing means for sensing the temperature within the cavity, and control means which are responsive to the oven cavity temperature, or a function of temperature, and which, when the cavity temperature reaches a predetermined level, are operative either to switch off the supply of power to the microwave generator and the thermal heating means if the cooking time is less that a predetermined time, or to reduce the amount of thermal power produced by the thermal heating means and increase the amount of microwave power produced by the microwave generator if the cooking time is greater than the predetermined time. Hence, control of the microwave power and thermal power delivered to the cavity is achieved by sensing the temperature of the oven cavity and adjusting the relative magnitudes of the thermal power and microwave power in dependence upon this sensed temperature. In one embodiment of the invention, after the cooking time has exceeded the predetermined time the raising of the cavity temperature to an upper threshold temperature defining said predetermined level causes the thermal power to be reduced from a high level to a low level and the microwave power to be increased from a low level to a high level, and the subsequent lowering of the cavity temperature to a lower threshold temperature causes the thermal power to be increased from the low level to the high level and the microwave power to be reduced from the high level to the low level.

Starting from a cold oven, the temperature will first increase fairly rapidly with high level thermal power until the upper threshold temperature is reached. In practice, it has been found that all food items other than dense or bulky items such as large cuts of meat or casseroles are cooked by the time that the cavity temperature reaches the upper threshold from a cold start. Hence, if this upper threshold is reached within the predetermined time, the oven switches off and cooking finishes. For larger food items, for which cooking continues after the predetermined time, when the upper threshold temperature is reached, the thermal power will be reduced to the low level and the microwave power increased from its low level to its high level. Once heated up, the oven temperature is therefore maintained between the upper and lower threshold temperatures to ensure that the outside of the food is browned by the hot air within the cavity as the inside of the food is cooked by the microwave power.

The invention is applicable to small domestic microwave ovens intended to be powered from a domestic socket outlet, as well as larger domestic and commercial ovens. In the case of domestic microwave ovens which are limited by the maximum power rating of the plug/socket, it is preferable for the oven to draw the maximum permitted power throughout the cooking process. To achieve this, the oven preferably draws substantially the same power when the oven is operating at high level thermal power and simultaneous low level microwave power, as when the oven is operating at low level thermal power and simultaneous high level microwave power. The feature of drawing the maximum permitted power throughout the cooking time is particularly important for ovens designed for countries such as therefor the USA and Japan where the maximum power rating of the domestic plug/socket is modest.

The high level thermal power may be substantially double the low level thermal power, and the high level microwave power may be substantially double the low level microwave power. In the embodiment to be described, which is designed for a maximum power input of 1600 watts to suit the United States market, the high level thermal power is 1000 watts and the high level microwave power is 500 watts for the magnetron and 250 watts delivered to the oven cavity. For a maximum power input of 1800 watts, these figures may be 1100 watts, 600 watts to the magnetron and 300 watts to the cavity.

The thermal heating means may comprise a heating element and the control means may be such that the heating element is powered by full wave alternating current for high level power and rectified half wave current for low level power. The microwave generator is conveniently powered through a single capacitor for low level microwave power and the control means are conveniently operative to connect a second capacitor in parallel with the single capacitor to power the microwave generator through these two capacitors in parallel for high microwave power.

The described way of sensing the oven cavity temperature and controlling the thermal power and microwave power represents a way of controlling the cooking process, without the need for pre-warming or complicated controls. It will be appreciated that a fully automatic cooking process can be achieved if the cooking process could be terminated automatically when the food is cooked. For most food items (other than large cuts of meat) which are cooked when the upper threshold temperature is reached, detection of this temperature is used to signal the end of the cooking process, providing the oven always starts from cold. Hence, the oven can be regarded as fully automatic for food items which are cooked before the predetermined time, typically between 25 and 35 minutes depending on the power input levels of the country of use.

For larger food items, one way of detecting the end of cooking is by the provision of moisture sensing means which sense the amount of moisture venting from the cavity, the moisture sensing means being associated with the control means such that the latter are operative to cause cessation of the production of thermal power and microwave power when the moisture sensing means sense that the moisture of the air vented from the cavity reaches a predetermined value. The moisture content of the air venting from the oven cavity increases as cooking progresses, and it is therefore possible to monitor the amount of this moisture to sense when cooking is complete. For many foods a plot of cavity moisture against time produces a curve of similar characteristics, and this enables particular points on the curve to be detected and used as an indication that cooking is complete.

The oven may be made to operate fully automatically for larger food items which take more than the predetermined time to cook. This is conveniently achieved by monitoring the decline in the cavity temperature after the predetermined time. Preferably, after the predetermined time, the control means are responsive to the temperature sensing means to switch off the oven if the cavity temperature, or a function thereof, drops to a first sub-level during a first time interval from the effluxion of the predetermined time or from the oven cavity temperature reaching the predetermined level.

The control means may be responsive to the temperature sensing means to switch off the oven if the cavity temperature, or a function thereof, drops to a second sub-level, lower than the first sub-level, during a second time interval from the effluxion of the first time interval, and to switch off the oven if the cavity temperature, or a function thereof, drops to a third sub-level, lower than the second sub-level, during a third time interval from the effluxion of the second time interval.

The oven preferably has a blower or fan for directing cooling air over the microwave generator, and diverting means such as a flap or damper for directing the cooling air either into the cavity to cool the latter or to the surroundings. Preferably, the cool air is directed to the surroundings when the thermal power and microwave power are being produced simultaneously, the flap directing the cooling air into the oven cavity to cool the latter after the moisture sensing means have been operative to cease production of the thermal power and microwave power on completion of cooking. This ensures that, as far as possible, a subsequent cooking operation will be commenced with the oven in a cold or cool condition. This is the preferred starting condition because the temperature time variation then follows a predictable pattern, although the oven operates satisfactorily with, and compensates for, a warm start as previously mentioned.

According to a further aspect of the invention there is provided a method of cooking food in a microwave oven having a cavity supplied with microwave power simultaneously with thermal power, comprising sensing the temperature within the cavity and automatically switching off the oven to complete the cooking process when the cavity temperature, or a function thereof, reaches a predetermined level.

A microwave oven according to the invention will now be described, by way of example, with reference to the accompanying drawings, in which:

DETAILED DESCRIPTION OF THE DRAWINGS AND THE PREFERRED EMBODIMENTS

Figure 1:
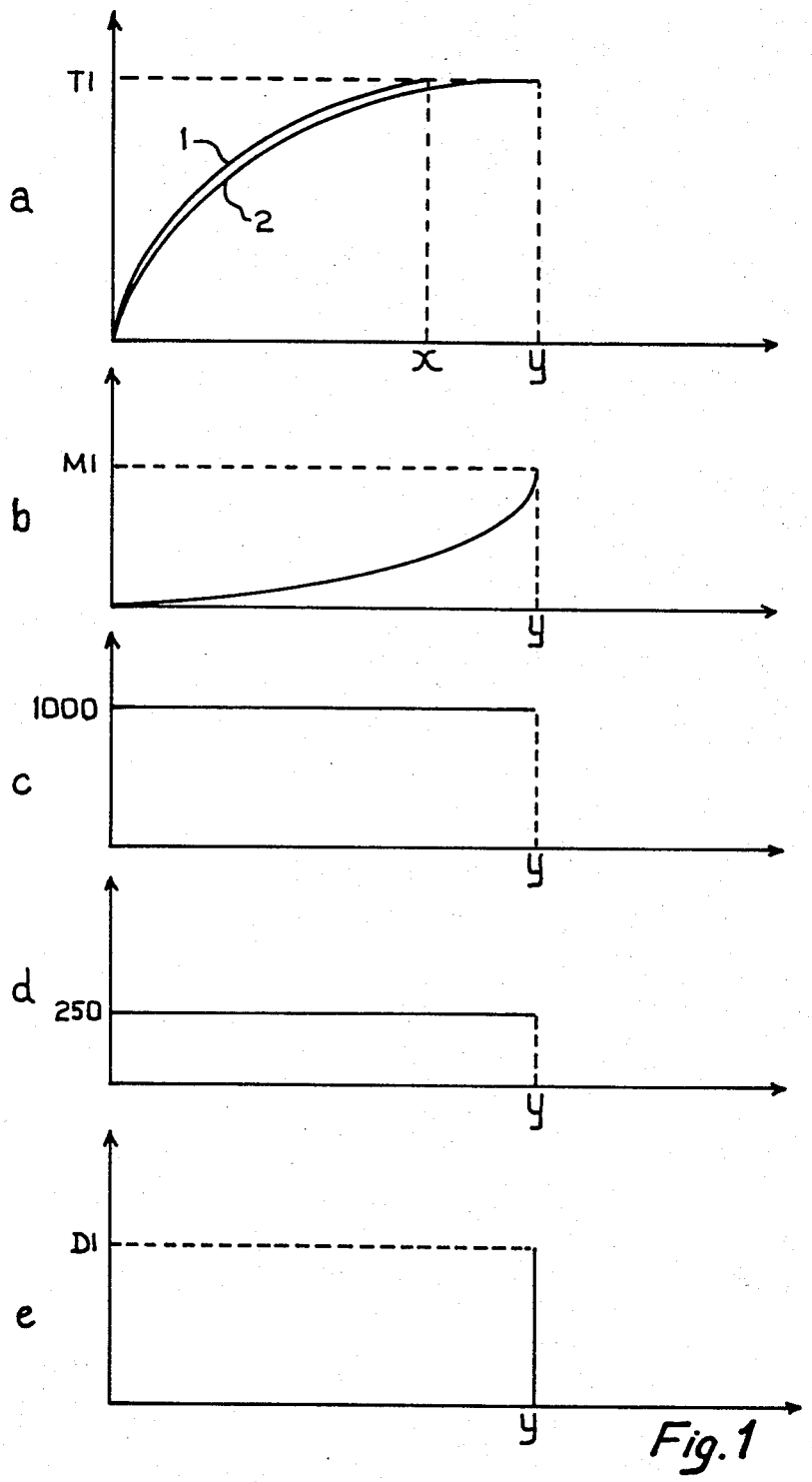
FIGS. 1*a–e* and FIGS. 2*a–e* show graphs useful in explaining the operation of the oven.

FIG. 1*a* shows oven temperature plotted against time. Curve 1 shows the temperature time variation for the described embodiment of oven operating under empty conditions. It will be seen that the empty oven takes time x to reach a temperature T1 suitable for browning. Time x is therefore the shortest time in which the oven can reach temperature T1. When food is placed in the oven curve 1 will be followed providing that the microwave power heats up the food mass to an extent such that the surface temperature of the food is the same as the air temperature surrounding it. It has been found for many light foods such as small flans and pies, the temperature/time variation can indeed be made to follow curve 1 by suitable choice of the level of microwave power delivered to the cavity.

For larger food items the oven cavity takes longer to reach temperature T1, as indicated by curve 2 which reaches temperature T1 after time y. FIGS. 1*b* to *e* relate to such larger food items.

FIG. 1*b* shows the variation of moisture (which is produced by the microwave power and removed from the cavity) plotted against time. It will be seen that this rises, first gradually and then more steeply to reach a level M1 after time y.

FIG. 1*c* shows that a constant power of 1000 watts is applied as thermal power up to time y. FIG. 1*d* shows a constant power of 250 watts delivered to the cavity as microwave power up to time y.

FIG. 1*e* shows the electrical signal produced by a moisture sensor which senses the amount of moisture or humidity in the air vented from the oven cavity. It will be seen that the electrical output of the moisture sensor is zero until time y when it rises suddenly to a value D1 to indicate moisture level M1.

By experiment, it has been found that all foods except for heavy cuts of meat cook through and are browned by time y, although the value of y will differ with the density and size of the food item. By setting temperature T1 at about 250° centigrade all these food items cook satisfactorily and are browned by time y, assuming that the oven has commenced from a cold start.

Figure 2:
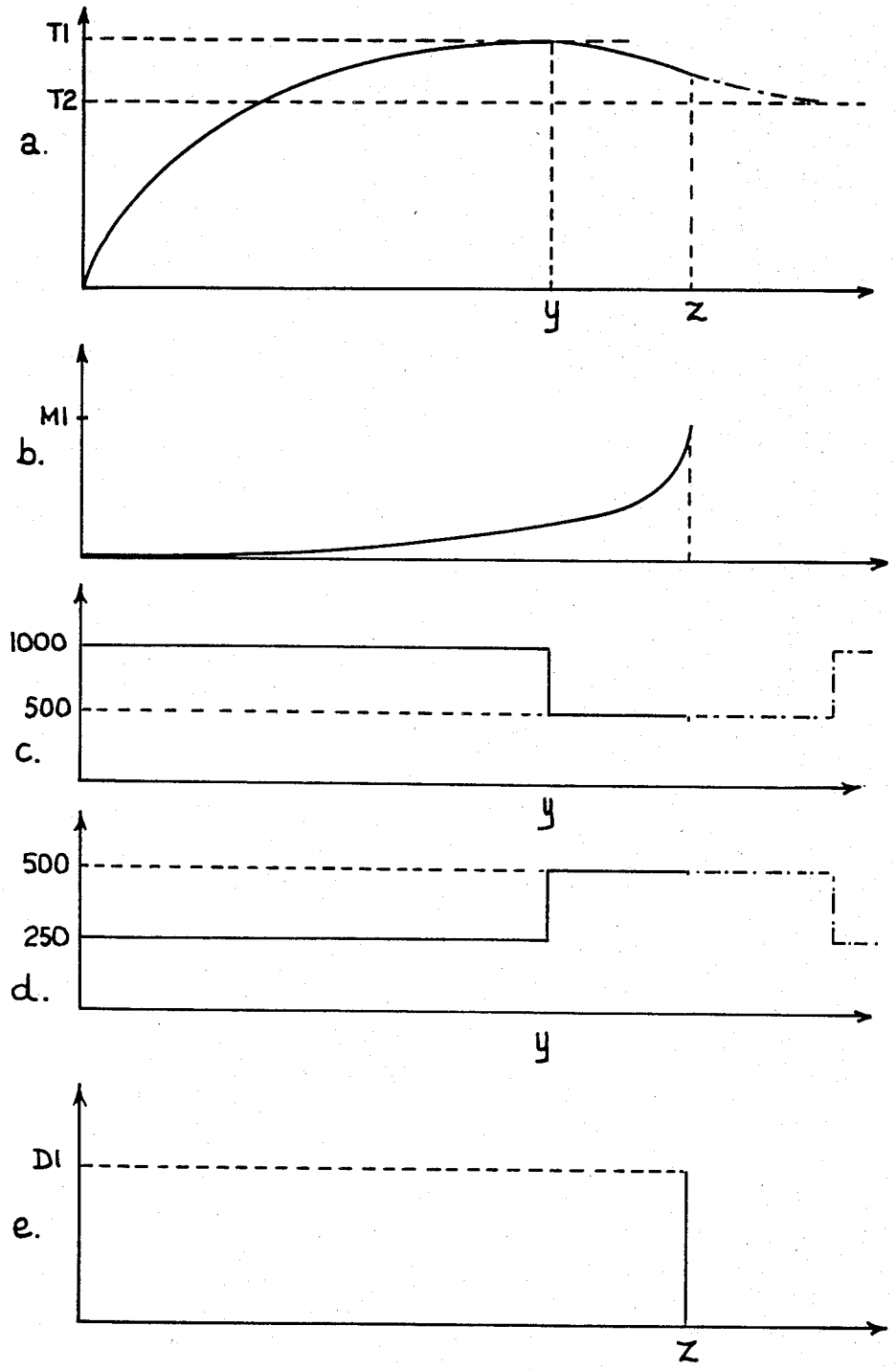

Large cuts of meat take longer to cook and FIG. 2 shows how the levels of thermal power and microwave power delivered to the cavity are varied to ensure cooking in the quickest possible time consistent with maximum power being taken by the oven throughout the cooking period. FIG. 2*a* shows that the meat surface takes time y to reach temperature T1, this time being longer than that required for the lighter food items. At time y the moisture level detected by the moisture sensor is still quite low as shown by FIG. 2*b*.

FIG. 2*c* shows how at time y the thermal power is reduced from 1000 watts to 500 watts, and FIG. 2*d* shows how the microwave power into the cavity is increased at time y from 250 watts to 500 watts. Hence, after time y the microwave oven consumes the same total power as before time y, bearing in mind that the microwave generator is only about 50% efficient.

In consequence of the thermal power being reduced, the cavity temperature starts to fall slightly, but the temperature is still sufficient for browning to continue. The increased microwave power speeds up the cooking of the meat while the reduced thermal power ensures that the cavity temperature does not drop too fast or too low. At time z the moisture level detected by the moisture sensor has reached the predetermined level M1 and this signifies the end of cooking. As before, when the moisture level reaches M1 the moisture sensor produces an output signal D1, as indicated in FIG. 2*e*.

Reverting to FIG. 2*a*, cooking is complete at time z but the curve is continued after time z to indicate what happens if the oven temperature drops to T2. This might happen before time z if, for example, the oven door were opened. Should the oven temperature drop to T2 (e.g. 220° C.) the thermal power is restored to its high level of 1000 watts and the microwave power is reduced to its lower level of 250 watts into the cavity. As will be explained the oven cavity is fitted with temperature sensing means which detect when the oven temperature rises to T1 or falls to T2, the result being that the oven temperature is kept between the upper threshold of T1 and the lower threshold of T2 once the oven has heated up.

Figure 3:
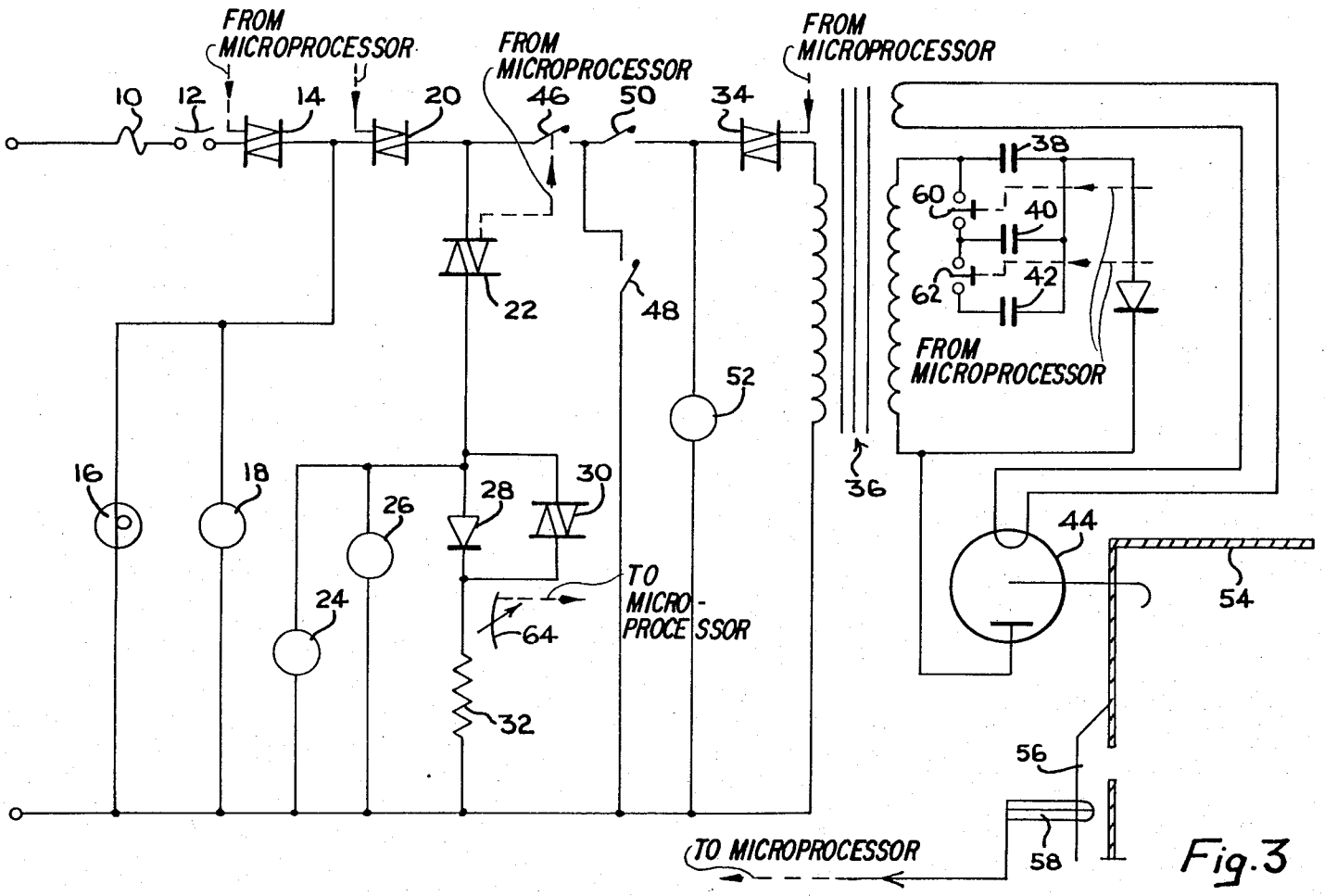
FIG. 3 is an electrical circuit diagram of the oven.

The circuit diagram of FIG. 3 will now be described. Power is applied from the left hand side of FIG. 3 through a fuse 10 and a magnetron thermostat 12. A triac 14 controlled by a first timer governs the supply of power to a cavity lamp 16 and a blower 18 for the magnetron. Beyond the triac 14 is a further triac 20 which is controlled by another timer and through which current must pass before reaching a triac 22 and a parallel network comprising a convection motor 24, a relay 26 for operating a flap or damper, a diode 28 in parallel with a triac 30, and a thermal heating element 32. The convection motor 24 drives a fan for blowing air over the element 32, this forced flow of hot air being recirculated through the oven cavity so as to produce thermal power for browning the food to supplement the microwave power.

A triac 34 forms a microwave on/off switch, and inductive coils 36 transmit power through one or more capacitors 38, 40 and 42 to the magnetron 44. The oven has the usual door-latch switch 46, monitor switch 48, cook/start switch 50 and turntable motor 52.

A portion of the oven cavity is shown schematically at 54, the cavity 54 being vented through a moisture vent 56 within which is positioned the previously mentioned moisture sensor 58.

In use food is placed in the oven and the door closed. The oven has a control panel with touch sensitive pads, one of which marked "COM" (for combined microwave and thermal power) is touched. This turns on the triac 14 which in turn energizes the magnetron blower 18 and the cavity lamp 16. At the same time triacs 22, 30 and 34 are gated on. When a pad marked "COOK/-START" is touched the triac 20 is turned on, door-latch 46 and cook/start switch 50 being closed and monitor switch 48 being open. Power thus flows through the triacs 22 and 30 to energize the heating element 32 with full wave a.c. current. Also, the convection motor 24 and the relay 26 will be energized, the latter closing the flap or damper to divert cooling air from the magnetron blower away from the oven cavity.

The triac 34 is also closed and current flows through the coils 36, the magnetron 44 being operated at its low power level through the capacitor 38 because switches 60, 62 are open.

The heating element 32 continues to deliver high thermal power (1000 watts) and the magnetron to deliver low thermal power (250 watts) until time y. In the case of food items other that large cuts of meat, the moisture sensor 58 reaches level M1 at time y (FIG. 1*b*) and sends the signal D1 to the microprocessor control circuit which switches off the gate supply to triac 20, thereby causing cessation of thermal and microwave power and leaving the oven in a stand-by mode. Cooking is then complete. In this stand-by mode, the damper relay 26 is opened and cooling air from the magnetron blower 18 is directed into the oven cavity to cool the latter. A further pad marked RESET/OFF must be touched to turn the oven off completely.

For large cuts of meat (FIG. 2) the cavity temperature reaches T1 before the moisture sensor 58 reaches level M1. In this case, a cavity thermostat 64 sends a signal to the microprocessor which switches off the gate supply to the triac 30 and simultaneously brings the capacitor 40 into circuit by closing the switch 60. The heating element 32 is then powered by rectified half wave current through the diode 28, and produces low level thermal power (500 watts) into the cavity. At the end of cooking at time z, the moisture sensor 58 switches off the triac 20, leaving the oven in the stand-by mode.

Should the oven temperature drop to T2 (e.g. as a result of the oven door being opened), the thermostat 64 senses this and the triac 30 is gated closed and the switch 60 opened, causing the oven to revert to high level thermal power and low level microwave power.

The capacitor 42 and switch 62 are provided to enable a third, higher level of microwave power to be selected for microwave only operation.

Although triacs have been described, other switching devices like relays could be used.

Instead of having a triac 30 and diode 28 to control the amount of thermal power produced by the element 32, the latter may have tappings to bring appropriate parts of the element 32 into circuit to vary the thermal power produced.

The high level microwave power may be higher than 500 watts into the cavity, e.g. 650 watts, leaving about 200 watts available for low level thermal power. This smaller amount of thermal power may be sufficient to continue browning for the shorter time resulting from the use of increased microwave power.

The thermostat may be set so that T1 and T2 are 250° C. and 220° C. respectively for pastries, flans and all foods other than large cuts of meat. For large cuts of meat it may be desirable to reduce T1 and T2 to 230° C. and 200° C. respectively to reduce spitting of the fat and consequent fat deposits in the oven.

In the preceding description, it was mentioned that all food items, except for meat, are cooked by the time the cavity temperature reaches time T1. For these food items, this temperature T1 is reached within a predetermined time from a cold start. It is therefore possible for the oven to cook the items automatically, without the need for the operator to enter any cooking time. To achieve this result, the oven timing means are factory set to a predetermined time, e.g. to 30 minutes. If temperature T1 is reached before 30 minutes this is sensed by control means which switch off the oven, thereby finishing the cooking process. The precise magnitude of the predetermined time will depend on the power consumption of the oven. FIGS. 4*a–e* explain how an oven constructed as in FIG. 3 and having a maximum power input of 1800 watts can be operated automatically without the need to set time or temperature levels.

FIG. 4*a* shows a timer 70 of the timing means running to time 30 minutes. FIG. 4*b* is a plot of cavity temperature against time in the case of a normal food item being cooked in the oven. The oven reaches temperature T1 before the timer 70 ceases, and the oven is therefore switched off at the time temperature T1 is reached.

Operation after the predetermined time of 30 minutes is governed by further timers 72, 74 and 76 of the timing means. FIG. 4*c* is a plot of cavity temperature against time for a larger food item taking more than 30 minutes to cook. For such a food item, temperature T1 is not reached before timer 70 ceases at 30 minutes. Temperature T1 will be reached sometime after 30 minutes and this is sensed, firstly to switch the microwave power level from low to high (FIG. 4*d*) and the thermal power from high level to low level (FIG. 4*e*), and secondly to record that the maximum temperature T1 has been reached. The cavity temperature is monitored between 30 and 40 minutes, and at 40 minutes the timer 72 ceases. If the cavity temperature during this 10 minute interval falls to a first sub level (typically 210° C.) the oven switches off, providing the temperature T1 has previously been reached. If the cavity temperature at 40 minutes is above the first sub level, or temperature T1 has not been reached, cooking continues. The cavity temperature is monitored between 40 and 50 minutes, and at 50 minutes the timer 74 ceases. If the cavity temperature during this 10 minute interval falls to a second sub-level (typically 190° C.) the oven switches off, providing the temperature T1 has previously been reached. If the cavity temperature at 50 minutes is above the second sub-level, cooking continues until a third sub-level temperature (e.g. 170° C.) is reached or the timer 76 ceases at 60 minutes.

Chicken will be cooked between 30 and 40 minutes, most red meat items between 40 and 50 minutes and most very large meat (such at turkey) between 50 and 60 minutes. The cavity temperature is an accurate indication of the thermal load in the oven because the microwave power absorption and thermal conduction properties of smaller loads cause the cavity temperature to be less after 30 minutes than for larger loads. A summary of operation is as follows:

1. When the cook button is depressed, timer 70 is energized and mixed facility cooking with low level microwave power and high level thermal power commences. Timer 70 is preset to run for 30 minutes.

2. If the maximum temperature of 250° C. is reached within the 30 minute period of timer 70 the oven is programmed to switch off automatically.

3. If the maximum temperature of 250° C. is not reached before the 30 minute time then timer 70 switches off.

4. When the maximum temperature of 250° C. is reached the microwave power is increased from low level to high level and the hot air convection power reduced from high level to low level. Timer 72 is set to run for 10 minutes, commencing at 30 minutes.

5. During the period of timer 72 the cavity air temperature will slowly decrease in accordance with the conduction properties of the food item being cooked.

6. If during this period the oven temperature cools to 210° C. then the oven switches off automatically.

7. If 210° C. is not reached within the 10 minute period of timer 72, cooking continues and timer 74 is energized to time from 40 minutes to 50 minutes. The operation of timer 74 overrides the switch off of the oven and extends the cooling temperature to 190° C.

8. If during this further 10 minute period between 40 and 50 minutes the oven temperature cools to 190° C. the oven switches off to finish cooking. If the cavity temperature has not dropped to 190° C. at time 50 minutes timer 74 switches off and timer 76 is energised from time 50 minutes to 60 minutes.

9. Timer 76 operates from 50 minutes to 60 minutes and the oven is switched off if the oven cavity temperature drops to 170° C. during this period.

All the timing, temperature sensing and control operations will be carried out by a microprocessor, and in practice the timers 70 to 76 would be one timing device. Instead of using time and temperature for control of the oven, the micro-processor may compute a function of time or temperature (e.g. the time intergral of temperature variation with time) to control operation.

The mode of operation described with reference to FIG. 4 assumes constant input power, and a Triac circuit or similar may be necessary to even out mains power fluctuations. The need to start the cooking process from cold may be met by using a D.C. motor for blowing the hot air and by reversing the direction of this motor on warm start up to cause cold air to be drawn into the cavity. An auxiliary fan could be used in addition to blow cold air into the cavity.

Figure 4:
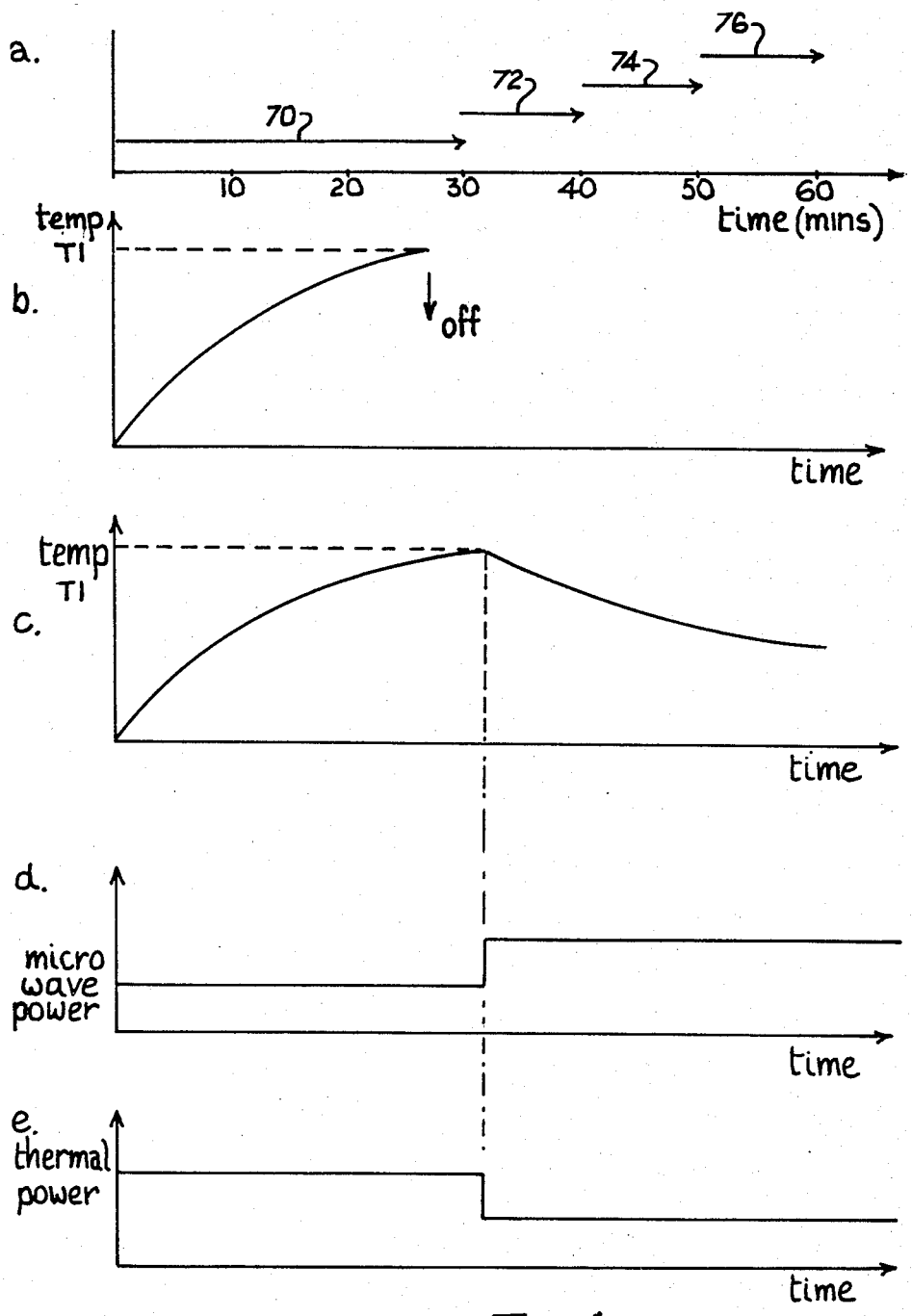
FIG. 4 shows a series of graphs illustrating an alternative mode of operation of the oven.

Because the mode of operation of FIG. 4 is automatic, it is desirable to prevent the oven door being open during cooking. This can be done by locking the door until the oven switches off.

The oven may be fitted with an additional electric heating element, such as a grill element, placed in the roof of the oven cavity. This is particularly advantageous for the Japanese market.

Having disclosed my invention, what I claim as new and to be secured by Letters Patent of the United States is:

1. A method of cooking food in a microwave oven having an oven cavity and a door for closing the cavity, comprising starting with the cavity of the oven in a cold condition, placing a food item into the cavity and closing the door, commencing a cooking process by applying to the food item continuous microwave power and simultaneously continuous thermal power by blowing a forced flow of hot air through the cavity, timing the cooking process from the commencement thereof, monitoring the temperature within the cavity or a function of said temperature, and ceasing the cooking process by ceasing the microwave power and the thermal power if the cavity temperature, or the function thereof, reaches a predetermined level within a predetermined time, continuing the cooking process with an increased level of microwave power and a decreased level of thermal power if the predetermined temperature is not reached within the predetermined time and ceasing the production of the microwave power at the increased level and the thermal power at the decreased level if the cavity temperature drops below a predetermined sub-level, lower than the predetermined level, after a further preset delay.

2. A microwave oven comprising a microwave generator for supplying microwave power to a cavity of the oven, thermal heating means for supplying thermal power for the cavity in the form of a forced flow of hot air through the cavity, the microwave generator and the thermal heating means producing the microwave power and the thermal power simultaneously and continuously from commencement of cooking, timing means for monitoring the cooking time, temperature sensing means for sensing the temperature within the cavity, and control means which are responsive to the timing means and the temperature sensing means and which when the cavity temperature, or a function of the cavity temperature, reaches a predetermined level are operative either to switch off the supply of power to the microwave generator and the thermal heating means if the cooking time is less than a predetermined time, or to reduce the amount of thermal power produced by the thermal heating means and increase the amount of microwave power produced by the microwave generator if the cooking time is greater than the predetermined time.

3. A microwave oven according to claim 2, wherein said predetermined time is between 25 and 35 minutes, so that all food items except meat are cooked within said predetermined time.

4. A microwave oven according to claim 2, wherein means are provided to ensure that the oven is cool at the commencement of the cooking time.

5. A microwave oven according to claim 2, wherein after the cooking time has exceeded the predetermined time the raising of the cavity temperature to an upper threshold temperature defining said predetermined level causes the thermal power to be reduced from a high level to a low level and the microwave power to be increased from a low level to a high level, and the subsequent lowering of the cavity temperature to a lower threshold temperature causes the thermal power to be increased from the low level to the high level and the microwave power to be reduced from the high level to the low level.

6. A microwave oven according to claim 2, wherein after the predetermined time the decreasing cavity temperature, or a function thereof, determines when the control means switch off the oven.

7. A microwave oven according to claim 6, wherein after the predetermined time, the control means are responsive to the temperature sensing means to switch off the oven if the cavity temperature, or a function thereof, drops to a first sub-level during a first time interval from the effluxion of the predetermined time or from the oven cavity temperature reaching the predetermined level.

8. A microwave oven according to claim 7, wherein the control means are responsive to the temperature sensing means to switch off the oven if the cavity temperature, or a function thereof, drops to a second sub-level, lower than the first sub-level, during a second time interval from the effluxion of the first time interval, and to switch off the oven if the cavity temperature, or a function thereof, drops to a third sub-level, lower than the second sub-level, during a third time interval from the effluxion of the second time interval.

* * * * *